US006257465B1

(12) United States Patent
Treadwell

(10) Patent No.: US 6,257,465 B1
(45) Date of Patent: Jul. 10, 2001

(54) ICE DISPENSER

(76) Inventor: Paul Treadwell, 66 Roosevelt Rd., Rochester, NY (US) 14618

( * ) Notice: Subject to any disclaimer, the term of this patent is extended or adjusted under 35 U.S.C. 154(b) by 0 days.

(21) Appl. No.: 09/434,238

(22) Filed: Nov. 5, 1999

(51) Int. Cl.[7] ..... B65D 25/42
(52) U.S. Cl. ..... 222/572
(58) Field of Search ..... 222/460, 462, 222/463, 566, 572; 62/344

(56) References Cited

U.S. PATENT DOCUMENTS

| | | | | |
|---|---|---|---|---|
| D. 218,487 | * | 8/1970 | Flores | D67/3 |
| 3,642,162 | * | 2/1972 | Doman et al. | 62/344 |
| 4,047,633 | | 9/1977 | Trombly . | |
| 4,095,439 | * | 6/1978 | LInstromberg | 62/344 |
| 4,189,063 | | 2/1980 | Matthiesen . | |
| 4,228,923 | | 10/1980 | Barnard . | |
| 4,269,039 | | 5/1981 | Baker . | |
| 4,285,212 | | 8/1981 | Prada . | |
| 4,512,502 | | 4/1985 | Landers . | |
| 4,619,380 | | 10/1986 | Brooks . | |
| 4,627,556 | | 12/1986 | Brooks . | |
| 4,789,130 | * | 12/1988 | Stich et al. | 62/344 |
| 4,957,224 | * | 9/1990 | Kessler et al. | 222/465.1 |
| 4,981,237 | | 1/1991 | Landers . | |
| 4,997,109 | | 3/1991 | Carper . | |
| 5,033,273 | | 7/1991 | Buchser et al. . | |
| 5,037,004 | | 8/1991 | Katz et al. . | |
| 5,077,985 | | 1/1992 | Buchser et al. . | |
| 5,158,216 | * | 10/1992 | Viani | 222/465.1 |
| 5,240,150 | | 8/1993 | Palmon . | |
| 5,272,888 | | 12/1993 | Fisher et al. . | |
| 5,273,219 | | 12/1993 | Beach, Jr. et al. . | |
| 5,279,445 | | 1/1994 | Fisher et al. . | |
| 5,293,757 | | 3/1994 | Nishio . | |
| 5,297,394 | | 3/1994 | Frohbieter et al. . | |
| 5,487,486 | | 1/1996 | Meneo . | |
| 5,501,367 | | 3/1996 | Chigira . | |
| 5,526,854 | | 6/1996 | Unger . | |
| 5,555,740 | | 9/1996 | Stevenson . | |
| 5,683,011 | | 11/1997 | Miliani . | |
| 5,787,724 | | 8/1998 | Pohl et al. . | |

* cited by examiner

*Primary Examiner*—Kevin Shaver
*Assistant Examiner*—David Deal
(74) *Attorney, Agent, or Firm*—Brian B. Shaw, Esq.; Stephen B. Salai, Eq.; Harter, Secrest & Emery LLP

(57) ABSTRACT

A container for holding ice cubes and for controllably and quickly dispensing the ice cubes into a receiving vessel without undue spillage. The container includes a chute having a closed periphery.

10 Claims, 4 Drawing Sheets

FIG. 2
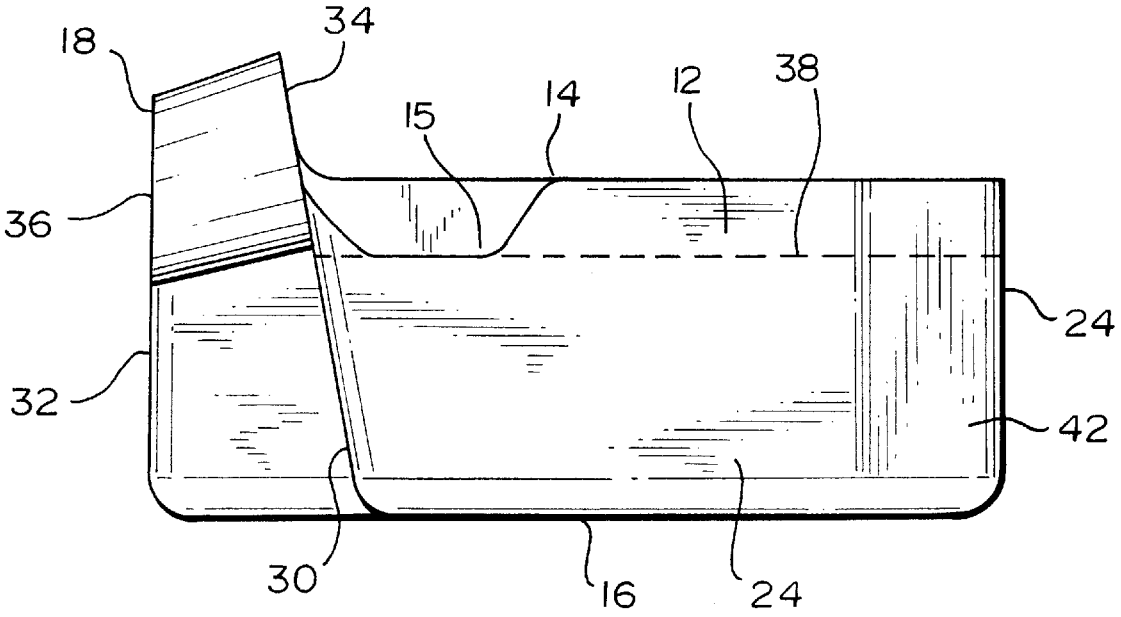
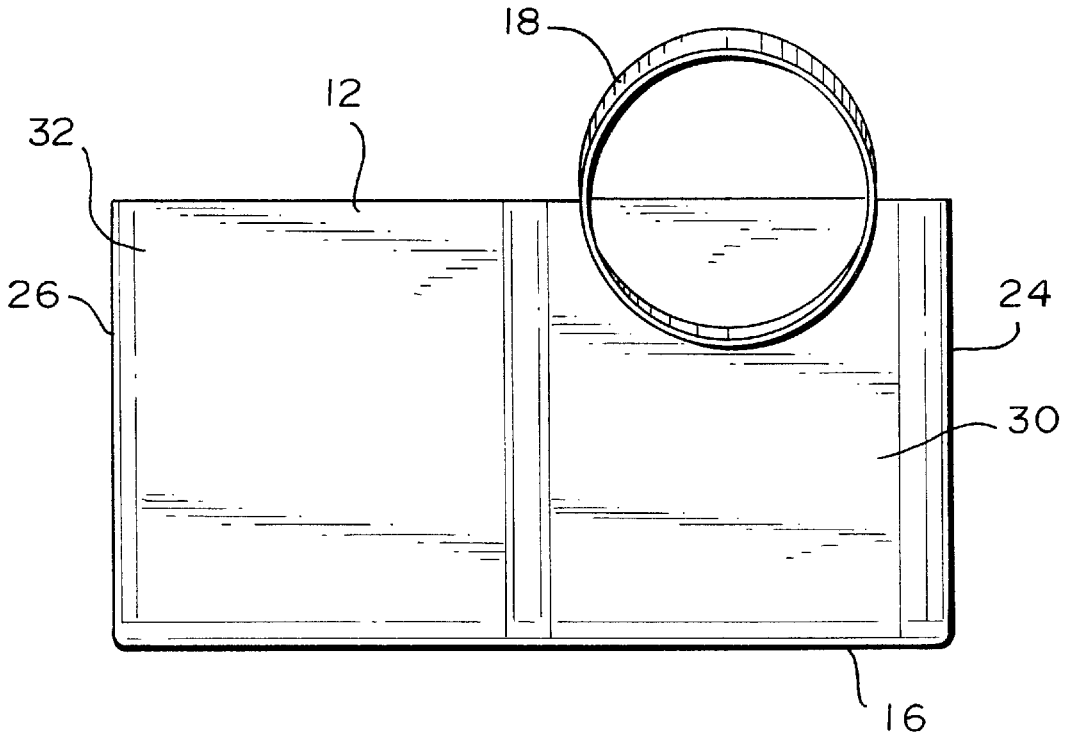
FIG. 3

ICE DISPENSER

FIELD OF THE INVENTION

This invention relates to a container for holding ice cubes and for controllably dispensing the ice cubes into a drinking vessel.

BACKGROUND OF THE INVENTION

Various methods of making and distributing ice cubes are known in the art. In this specification, the term "ice cube" will be understood to refer to any fragment of ice of a size and shape which is customarily contained in drinking vessels for the purpose of keeping beverages cool. While many such fragments indeed have a generally cubic appearance, other shapes are known, such as cylinders and segments thereof, or less regular shapes.

A common method of making ice cubes is to manually fill separate compartments of an ice cube tray with water which is frozen in a freezer. Using the formed ice cubes involves the inconvenience of removing them from the ice cube tray and usually transferring them to an intermediate storage container which is kept in the freezer, or an insulated ice bucket when more immediate use is required. The ice is normally handled with a scoop, a pair of tongs or even with the fingers to transfer it to a drinking vessel.

In instances where a comparatively large quantity of ice is required, manufactured ice may be purchased and stored in a freezer. Portions of the manufactured ice can be transferred to an intermediate storage container as required.

In refrigerators which have automatic ice makers, ice cubes are dispensed into a holding container in a freezer compartment of the refrigerator. This container has a function equivalent to that of the intermediate storage containers for the manually made ice cubes.

In some cases, the holding container is part of a system which allows ice cubes to be automatically dispensed on demand into a drinking vessel through a chute in the freezer compartment door. While this represents a convenience to the user, the process is sometimes too slow, since there is on occasion a need to distribute relatively large quantities of ice in a short time.

It would be advantageous to dispense ice directly into several drinking vessels in fairly quick succession. A conventional holding container does not lend itself to this; when tipping the container to pour ice cubes into a drinking vessel, it is difficult if not impossible to control the ice cubes exiting the container. Not only is there a lack of structure to guide the ice into a receiving vessel, but also ice cubes build up near the rim of the container until it is tipped too far, whereupon an excess of ice exits the container, typically overfilling the vessel and being spilt on the floor. Alternative current systems also include automatic ice making machines. These automatic machines fill a cube mold, displace the ice into a reservoir and translate the ice through a freezer door to facilitate translation of the ice from the reservoir, the automatic dispenser draw the ice from the bottom, or lower portion, of the reservoir. Therefore, the need still exists for an ice dispensing structure which facilitates selective dispensing of the ice. The need also exists for an accurate dispensing of the ice without requiring extensive or complicated mechanical drives.

SUMMARY OF THE INVENTION

The apparatus of the present invention addresses these problems. The apparatus includes a storage compartment in which ice cubes are stored and a chute with an inlet and an outlet for the ice, the chute providing a passageway for the ice which is completely enclosed for a least a part of its length. In one embodiment, the apparatus further includes a hold-back flange to reduce unintended translation of the ice from the storage. The apparatus can be used for storing ice which it receives from an automatic ice maker, or ice which is manually produced in ice-cube trays, or manufactured ice.

BRIEF DESCRIPTION OF THE DRAWINGS

FIG. 2 shows a side elevation of the preferred embodiment.

FIG. 3 shows a front elevation of the preferred embodiment.

DETAILED DESCRIPTION OF THE PREFERRED EMBODIMENT

Figure 1:
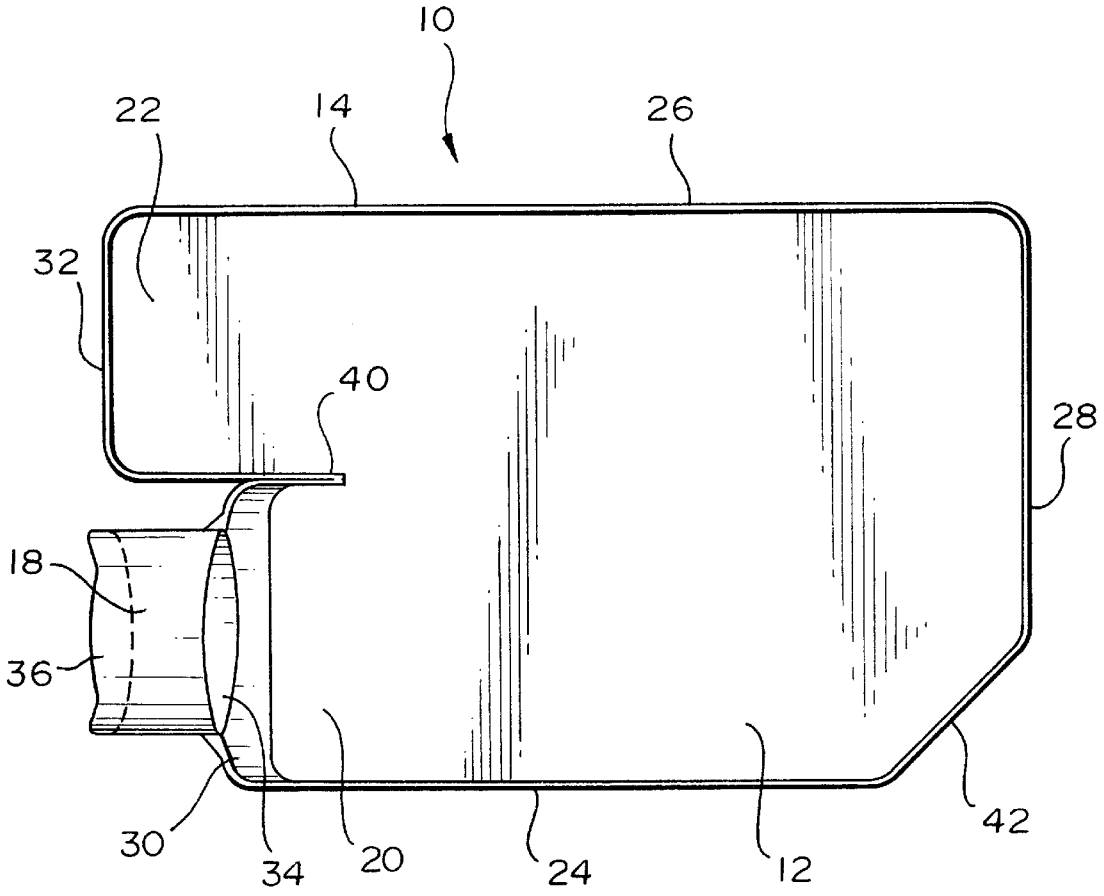
FIG. 1 shows a plan view of a preferred embodiment of an ice dispenser.

Referring now to FIGS. 1, 2 and 3, these show the preferred embodiment of an ice dispenser 10, which includes a storage compartment 12 with a peripheral wall or enclosure 14, a floor 16, and a chute 18 mounted on the peripheral wall 14. The dispenser 10 is configured to fit in a freezer compartment of a refrigerator, wherein it accepts ice cubes from an automatic ice maker from manually actuated freezer trays or from bags of manufactured ice. It is intended for the storage of ice cubes and their easy distribution into receiving containers such as drinking vessels. The ice cubes may be urged from the dispenser 10 by manually pushing the ice cubes or appropriately tilting the dispenser so that the ice cubes migrate towards the chute 18 and are urged therethrough by gently shaking.

In the preferred embodiment, the storage compartment 12 has a first front portion 20 and a second front portion 22. Dispenser 10 is intended to replace a conventional ice storage container located in a freezer compartment of a refrigerator. While dispenser 10 has the same general configuration as a conventional ice storage container which it replaces, the dispenser is configured so that the entire structure, including the chute 18 which projects outward from the peripheral enclosure 14 can be located within the footprint and position of a conventional ice storage container. While the configuration of the conventional container might be useful as a reference, it will not be described since it is not a part of this invention. However, the differences between the conventional container and the ice dispenser of the present invention will be apparent to the reader.

The peripheral enclosure 14 of the ice dispenser 10 has two side walls 24 and 26, a rear wall 28, a first front wall 30 and a second front wall 32. The first and second front walls 30 and 32 are offset from each other as shown most clearly in FIG. 1. The chute 18 projects outwardly from the top of the first front wall 30, to a distance which is approximately equivalent to the offset between the two front walls 30 and 32. In other words, the offset effectively accommodates the length of the chute 18. It will be appreciated that the structure thus far described could occupy the same footprint as a conventional ice storage container having a single front wall which would be as far forward as the second front wall 32 of the present ice dispenser 10.

The chute 18 has the configuration of a cylinder which is open to its full diameter at both ends to provide an inlet 34 and an outlet 36. The chute 18 is mounted to the top of the first front wall 30, wherein about half of its diameter is recessed, as best seen in FIG. 3. The chute 18 is so disposed that it projects outward, with its inlet 34 co-planar with the first front wall 30. In the preferred embodiment, the axis of chute 18 slopes at an angle of approximately 10° from the horizontal, so that the outlet is lower than the inlet, as best illustrated in FIG. 2. It is understood that the chute may have any one of a variety of slopes. The first front wall 30 has a corresponding slope of approximately 10° from the vertical.

The inlet 34 is above a desired fill level 38. If the inlet 34 were below the fill level 38, or if the depth of ice extended above the fill level 38, ice would tend to overflow through the chute 18.

In FIG. 1, a partial barrier 40 can be seen projecting inward between the first front portion 20 and the second front portion 22 of the dispenser 10. When the dispenser 10 is relatively full of ice, barrier 40 prevents an excess of ice cubes building up near chute inlet 34 and helps to avoid jamming. On the other hand, when dispenser 10 contains relatively little ice, barrier 40 can be used as a funnel to guide the ice cubes towards chute 18.

As well as having side walls 24 and 26, the front walls 30 and 32 and the rear wall 28, storage compartment 12 has, as best seen in FIG. 1, a diagonally oriented wall 42 between side wall 24 and the rear wall 28. This is to provide clearance for a vent such as is typically found in many freezer compartments, and is not essential to the invention.

It is further contemplated that the dispenser 10 may include a retaining wall extending upward from the floor and spaced from the inlet to the chute. The retaining wall may have a height that is between the inlet of the chute and the top of the peripheral wall. The retaining wall permits a high fill level in the dispenser, by exposing a reduced volume of ice cubes to the chute inlet.

The preferred embodiment would normally be applied to an ice dispenser which is specifically made to fit a particular freezer compartment with optimum use of space. However, other embodiments are possible whereby a more generic apparatus can be provided for general use in any freezer compartment.

As shown in FIG. 2, a portion of the peripheral wall 14 includes a recess or cut out 15 to provide access to the interior of storage compartment. Preferably, the recess 15 does not extend below the fill line of the storage compartment. The recess is sized to permit a user to introduce their hand into the storage compartment and urge ice cubes through the chute.

Figure 4:
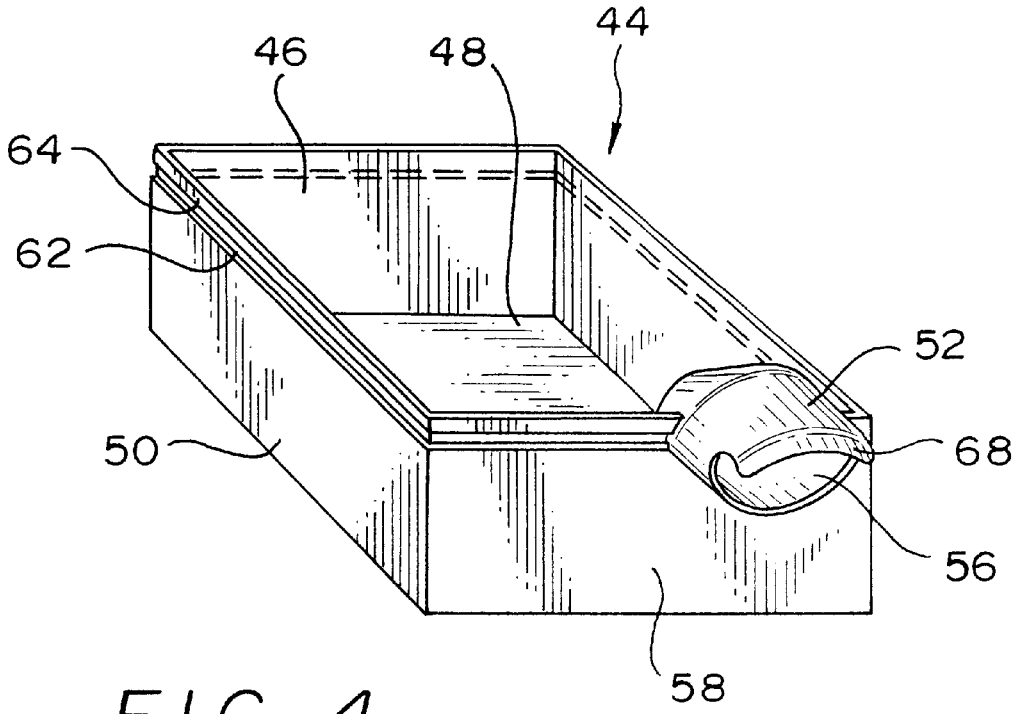
FIG. 4 shows a perspective view of another embodiment of an ice dispenser.
Figure 5:
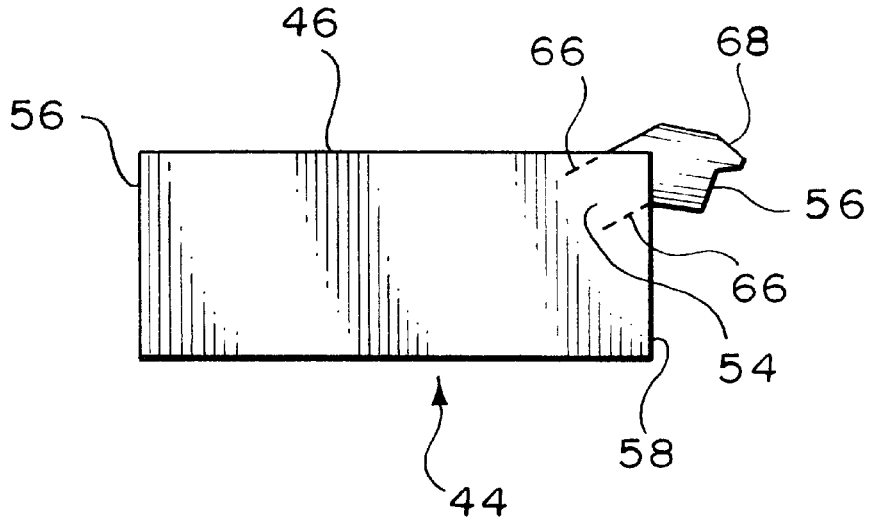
FIG. 5 shows a simplified side elevation of the embodiment of FIG. 4.

FIGS. 4 and 5 illustrate an ice dispenser 44 for general use. This embodiment has a regularly shaped, typically rectangular, storage compartment 46 with a floor 48, an enclosure 50 and a chute 52 with an inlet 54 and an outlet 56. The chute 52 is positioned towards one side of a single front wall 58. This embodiment may optionally have a central barrier similar to 40 to control the ice exiting through chute 52.

Figure 6:
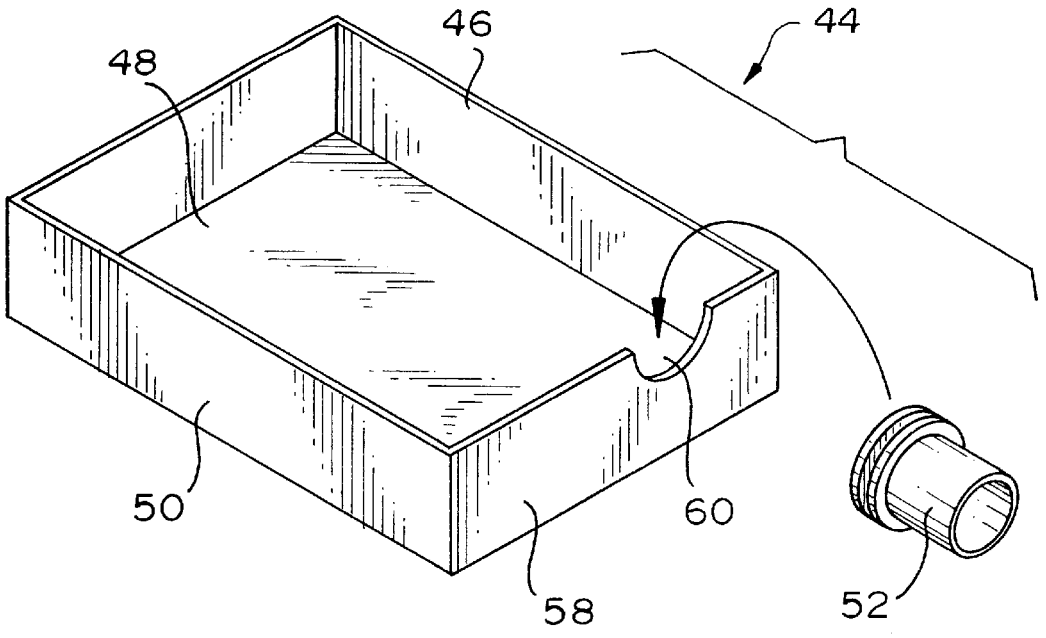
FIG. 6 shows a perspective view of an ice storage compartment and a chute.
Figure 7:
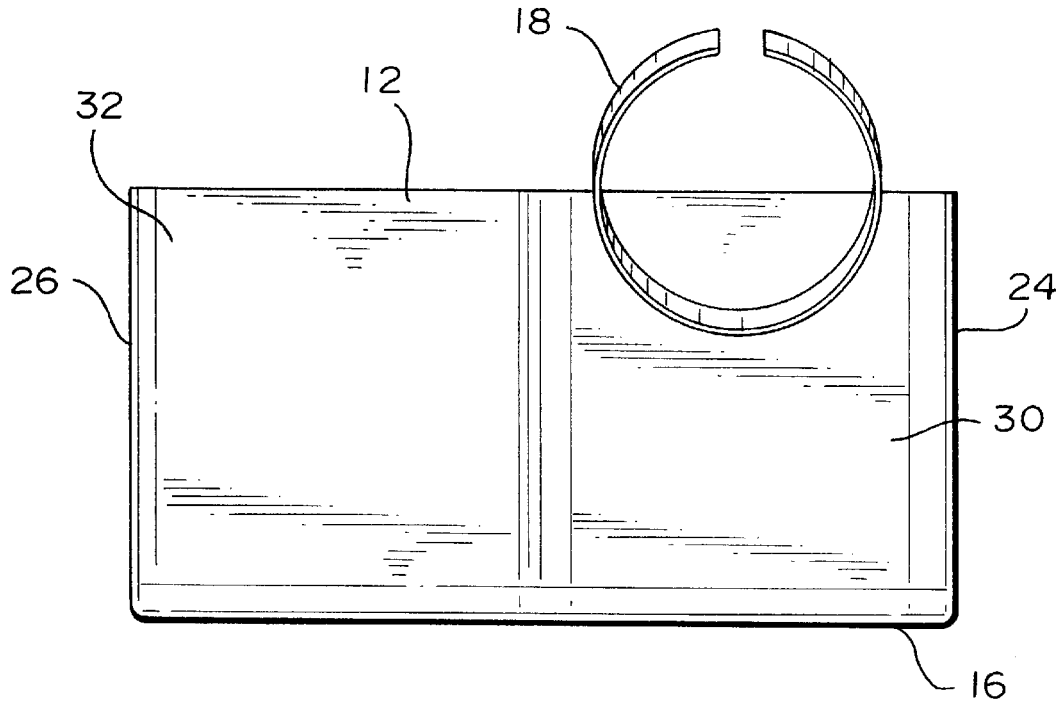
FIG. 7 is a front elevational view of an alternative configuration.

FIG. 6 shows another embodiment, wherein the chute 52 can be a separate piece which can be selectively added on to the storage compartment 46 by slotting it into a recess 60 which is configured to receive it. For example, this would be useful if it were desired to keep an ice dispenser in a space too low to accommodate the chute.

The embodiment illustrated in FIG. 5 can optionally include an indent 62 around the outside of enclosure 50 and spaced a short distance below the top of the enclosure. Indent 62 provides a frangible band of material which allows an uppermost strip 64 of the enclosure 50 to be snapped off, reducing the effective height of the storage compartment 46. This permits the dispenser to fit in a more confined space than previously.

Further, although the chute 18 is shown as a complete loop, it is contemplated the chute may be formed by a pair of arms 84 extending upwardly from the peripheral wall. The arms 84 may extend to contact each other or define a clearance therebetween. Any such clearance is sized to substantially preclude the passage or retention of an ice cube therebetween.

All embodiments can have optional hold-back flanges such as 66, as seen in FIG. 5 extending back from inlet 54 of chute 52. These interfere sufficiently with ice cubes entering chute 52 to prevent excessive ice from unintentionally passing from the storage compartment.

The chute 18 or 52 may depart from the precise form of a cylinder while retaining general characteristics thereof, for example, it may have an elliptical cross section. Other variations in shape are possible. For example, FIGS. 4 and 5 show chute 52 with a downward extension 68 at outlet 56 which helps to avoid ice cubes overshooting the receiving vessel.

As well as being used for the storage of ice in a refrigerator, the dispenser 44 might also function to hold ice for a limited time at room temperature in the same way as an ice bucket. In this case, it may be held in an insulated outer container such as a bag designed for the purpose, with just the chute exposed.

Ice dispensers 10 and 44 can be made from hard plastic of a type customarily used in the art, or from metal. In the preferred embodiment, the entire ice dispenser comprising storage compartment 12 and chute 18 is molded from plastic as a single unit. Alternatively, when chute 52 is made to be removably attached to storage compartment 46 to form ice dispenser 44, each component is molded from plastic as an integral but distinct part.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material of the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. An apparatus for selectively retaining ice cubes, comprising:

(a) a storage compartment having a floor and a peripheral wall, the floor and the peripheral wall configured to retain a plurality of ice cubes; and (b) a chute connected to the peripheral wall in a transverse orientation, the chute having an inlet above the floor and open to the storage compartment and an outlet having a continuous periphery spaced from the peripheral wall, the outlet located along a vertical dimension intermediate the floor and the inlet.

2. The apparatus of claim 1, wherein the chute is fixedly connected to the peripheral wall.

3. The apparatus of claim 1, wherein the chute is removably connected to the peripheral wall.

4. The apparatus of claim 1, wherein the peripheral wall includes a weakened line spaced from a terminal edge of the wall, the weakened line facilitating separation of a portion of the wall.

5. The apparatus of claim 1, further having a hold-back flange at the inlet of the chute.

6. An apparatus for containing and distributing ice cubes, comprising:

(a) a storage compartment having a floor and a peripheral wall which has a first front wall bounding a first front portion of the compartment and a second front wall bounding a second front portion of the compartment;

(b) a chute connected to the first front wall, the chute having an inlet above the floor and open to the storage compartment, and a continuous periphery outlet outwardly spaced from the first front wall; and (c) a barrier between the first and second front portions to control the entry of ice into the chute.

7. The apparatus of claim 6, wherein the first and second front walls are offset by a distance which accommodates the chute.

8. An apparatus for retaining ice cubes, comprising:

(a) a storage compartment having a peripheral wall including a first front wall and a recessed second front wall; and (b) a chute connected to the second front wall, the chute having an inlet, a spaced apart outlet and an intermediate continuous peripheral wall, the outlet being located below the inlet.

9. An apparatus for selectively retaining and dispensing a plurality of ice cubes, comprising:

(a) a storage compartment having a floor and a peripheral wall, the floor and the peripheral wall configured to retain a plurality of ice cubes; and (b) a chute connected to the peripheral wall, the chute having an inlet located above the floor and open to the storage compartment and an outlet having spaced from the peripheral wall, the chute at least partially formed by a pair of spaced apart arms, each arm having a terminal end, a spacing between the terminal ends selected to preclude passage of the ice cubes therebetween.

10. The apparatus of claim 9, wherein the peripheral wall includes a front wall having a recessed portion, and the chute is connected to the recessed portion.

* * * * *